United States Patent [19]

Dorman

[11] Patent Number: 4,619,367

[45] Date of Patent: Oct. 28, 1986

[54] AUTOMATIC CARD SELECTOR FOR RANDOM-ACCESS CARD FILE SYSTEM

[75] Inventor: Isidore Dorman, Whitestone, N.Y.

[73] Assignee: NB Jackets de Puerto Rico, Cagua, P.R.

[21] Appl. No.: 676,926

[22] Filed: Nov. 30, 1984

[51] Int. Cl.[4] ..... B07C 5/36

[52] U.S. Cl. ..... 209/608; 209/610; 221/251

[58] Field of Search ..... 209/547, 608, 610, 617, 209/609, 554, 613; 221/125, 251; 414/330

[56] References Cited

U.S. PATENT DOCUMENTS

| | | | |
|---|---|---|---|
| 3,313,302 | 4/1967 | Lasley et al. | 209/608 |
| 3,592,305 | 7/1971 | Schwertfeger | 221/125 |
| 3,713,535 | 1/1973 | Engelstein et al. | 209/608 |
| 3,800,942 | 4/1974 | Hirata et al. | 209/609 |
| 4,327,834 | 5/1982 | Kalthoff et al. | 209/610 |

*Primary Examiner*—Robert B. Reeves
*Assistant Examiner*—Donald T. Hajec
*Attorney, Agent, or Firm*—Michael Ebert

[57] ABSTRACT

A random-access card file system formed by card-storing cartridges, each capable of accommodating at least one deck of cards, and an automatic card selector adapted to extract any desired card therefrom regardless of its location in the cartridge. Each card in the deck includes an upstanding tab whose longitudinal position is related to a particular point on an incremental linear scale extending the full length of the deck. The selector includes a carriage movable to a position in registration with any desired incremental point on the scale, the carriage supporting a crane having a card picker thereon, whereby when the carriage is set to a particular scale point and a switch is actuated, the crane completes an operating cycle in the course of which it bows down over the cartridge to enable the picker to engage and clamp onto the tab of the selected card and to then lift the card to withdraw it from the cartridge. To prevent the picker from also withdrawing cards that stick on to the selected card, the upper corners of the deck are straddled by a pair of card separators, each having a row of gaps therein capable of passing only a single card, the entry to each gap in the row being defined by converging walls. When a selected card is lifted above the deck by the picker and other cards sticking to the selected card are also lifted, as the picker rises, it draws the upper corners of the selected card through the nearest entry in the row for passage through its gap, the other cards being intercepted by the walls of the entry and being caused to fall back into the deck.

9 Claims, 16 Drawing Figures

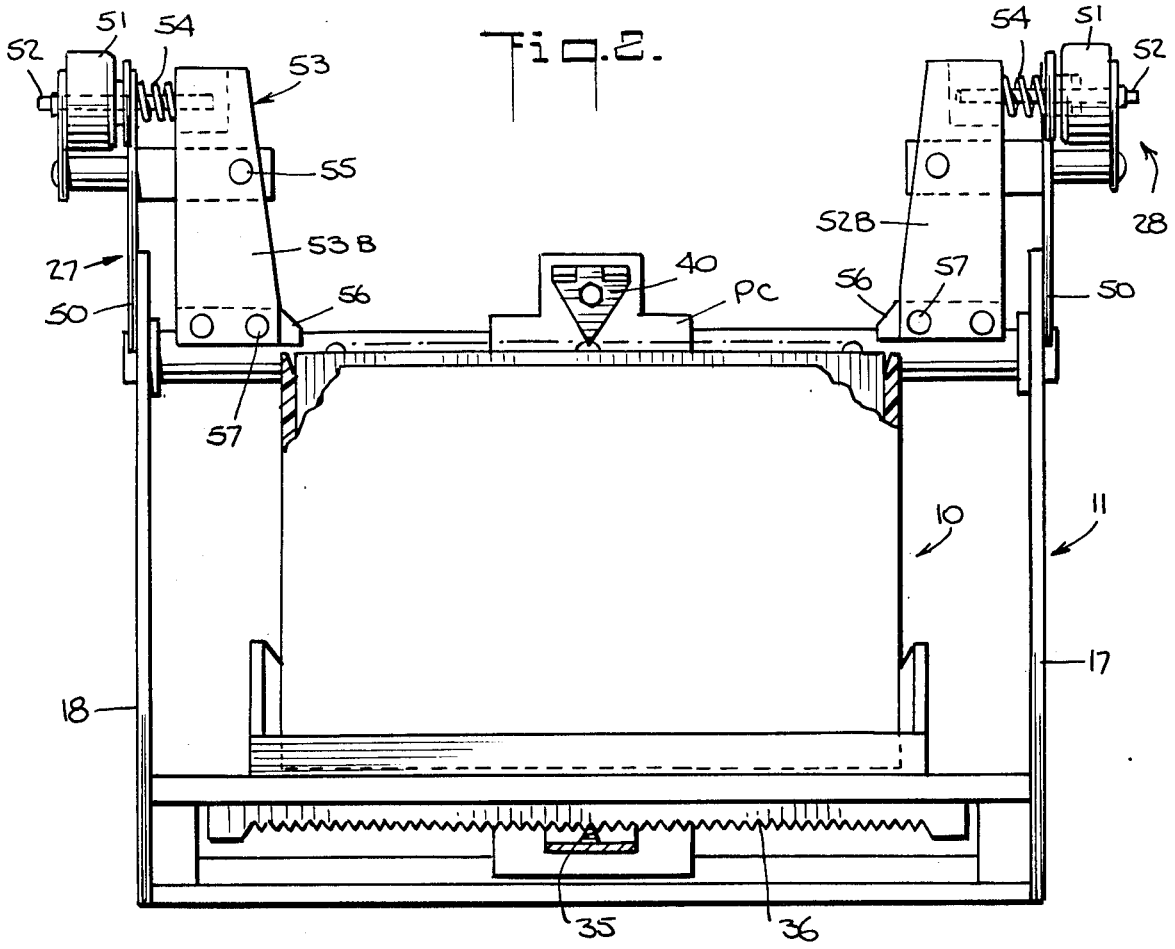
Fig. 2.
Fig. 13.
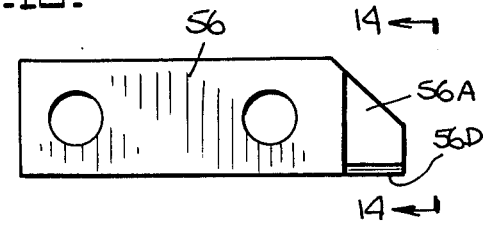
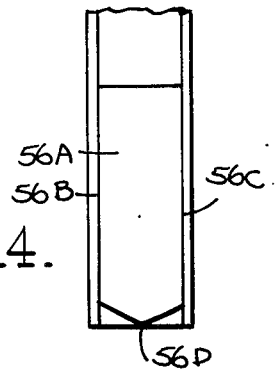
Fig. 14.
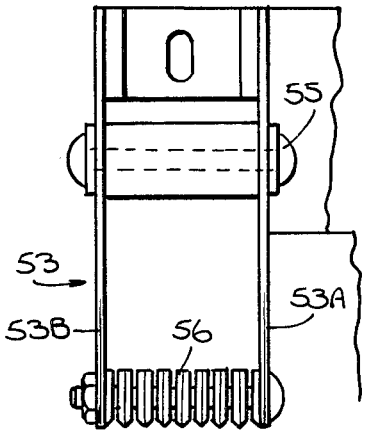
Fig. 12.
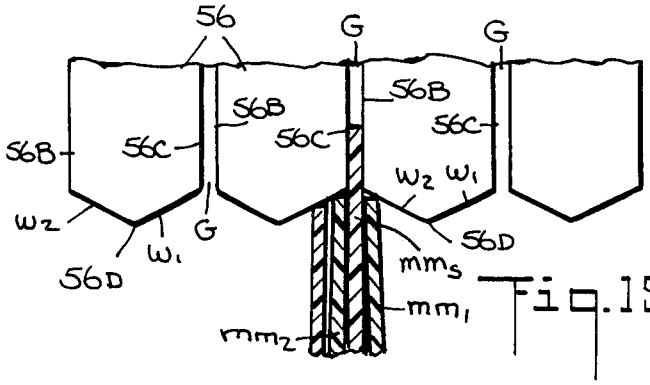
Fig. 15.

T
15
13
14
C2
C1
12

11
42
43
19
48
47
PC
23
46
45
44
20
24
25
40
22
41
MM
DII
10b
10
T
II
10c
I
DI
10a
16
34
33
36
35

62
60
PC
24
25
61
63
64
MICROPROCESSOR
59
COMPUTER
58
KEYBOARD

AUTOMATIC CARD SELECTOR FOR RANDOM-ACCESS CARD FILE SYSTEM

BACKGROUND OF INVENTION

1. Field of Invention

The invention relates generally to retrieval systems for randomly stored file cards, and more particularly to a system in which the file cards are stored in cartridges, the system being provided with an automatic selector adapted to withdraw any desired card from a cartridge regardless of its placement therein, and to present the extracted cards to the operator, the selector including means to detach from the selected card any cards which stick thereto 2. Status of Prior Art The term "card" as used herein is intended generally to cover any type of filing element which may be stacked in boxes or in any other form of file receptacle. The term therefore includes ordinary single-sheet file or tabulating cards, aperture cards in which a microfilm slide is mounted within a card aperture, microfiches and multi-channel microfiche jackets of the type disclosed in the Engelstein U.S. Pat. No. 3,238,655 as well as in the Dorman U.S. Pat. No. 3,553,439. Accordingly, the term "card" as used herein is intended to encompass any existing form of filing element formed by one or more sheets of paper, cardboard or plastic material or combinations thereof.

In an "ordered" card-filing system, the stacked cards are serially arranged in an alphabetical, numerical, or any other order in accordance with an established classification system. When in a system of the ordered type a clerk wishes to consult a particular card, he goes to the appropriate file box or drawer and then proceeds to search for that card. If, for example, the card bears identification number "126" and should be found in a file box intended for cards 100 to 199, the clerk riffles through the cards in that box until he locates card 126. After use, to avoid misfiling the clerk must be careful to return card 126 to its correct position in the proper file box.

Thus, in a conventional ordered file system, a substantial amount of clerical time is consumed not only in searching for and finding a given card, but also in returning the card to its proper position. Should the card be misfiled as a result of clerical error, the search to locate the misfiled card may take even more time.

In order to effect economies in clerical operations, data-retrieval systems have been developed adapted to extract a desired card from a stack or deck of randomly-stored cards. In existing data-retrieval systems, the system is arranged to quickly and accurately select from a large number of cards lying in face-to-face contact in a file, a particular card corresponding to a code marking or other form of identification in a master file index. The cards in any one file box may be in any random order. After being extracted from the file box for inspection, reproduction or other use, the card may be returned by the clerk to any position therein, yet it can subsequently be retrieved without difficulty.

In many random-access retrieval systems of the type in current use, the cards are formed with a series of edge notches and apertures which are sensed by sorting rods. Thus, in the well-known McBee Key Sort Card Selection System, each card, at its lower edge, has a series of equally-spaced apertures arranged in a row. These apertures define adjacent code locations or notch sites that are adapted to be selectively provided with one or more notches to facilitate, in cooperation with sorting rods, selection of a desired card from a deck of stored cards.

The Mosler retrieval system described in U.S. Pat. No. 3,536,194 is similar to the McBee system save that in Mosler, sorting rods act to leave the desired card available for selection and removal, whereas in McBee, the sorting rods positively engage the desired card for selection and extraction from the deck. Also of background interest is the random-access system disclosed in the Doundoulakis et al. U.S. Pat. No. 3,524,545 in which the cards are formed with coded notches along their upper edges.

The Mosler and McBee systems, as well as other commercially-available random access systems involving edge-notch cards operating in conjunction with sorting-rod mechanisms are relatively elaborate and expensive. The cost of existing random-access file systems is quite high, and in some instances prohibitive, so that the file user may be compelled by economic considerations to install a non-random ordered file system despite its inherent drawbacks.

The Engelstein-Dorman U.S. Pat.No. 3,713,537, whose entire disclosure is incorporated herein by reference, discloses an easily-operated random access system in which the file cards are stored in cartridges, an automatic selector common to all the cartridges making it possible to select any desired card from a cartridge regardless of its placement therein. Instead of cards having a complex pattern of notches or apertures, all that is entailed is one or more deck of cards stored in each cartridge, each card in the deck having an upstanding tab at a longitudinal position determined by its master index number.

The longitudinal position of each upstanding tab in the card deck is related to a particular point on an incremental linear scale extending the full length of the deck. The selector includes a carriage movable to a position in registration with any desired incremental point on the scale, the carriage supporting a crane having a card picker thereon whereby when the carriage is set to a particular scale point and a switch is then actuated, the crane completes an operating cycle in the course of which it bows down over the cartridge to enable the picker to engage and clamp onto the tab of the selected card and to then lift the card to withdraw it from the cartridge.

A major advantage of a random-access system of the Engelstein-Dorman type is that it is operationally compatible with traditional filing techniques. With this random-access system, it is not necessary to abandon existing file cabinets and storage facilities employed in the traditional system, for these may readily be adapted to the new system which makes use of file-card cartridges that may be stored in existing facilities.

The Engelstein-Dorman patent points out that because a non-selected card may possibly stick to the card selected by the picker, it may be improperly removed with the selected card. In order therefore to dislodge unwanted cards from the selected card onto which the picker is clamped, a vibrator is provided for this purpose.

However, a vibrator is only effective when the cards stick together lightly. When the adhesion between adjacent cards is relatively strong, the unwanted cards continue to stick despite the vibration. This problem is particularly troublesome when the cards are microfiche jackets of the type disclosed in the Engelstein U.S. Pat. No. 3,238,655 and in the Dorman U.S. Pat. No. 3,553,439. These multi-channel jackets are formed of front and rear clear polyester or Mylar panels which are joined together by parallel ribs which define the channels. Such polyester panels are notoriously tacky; and when the jackets are stacked in face to face relation in a deck, this promotes adhesion therebetween.

When such jackets are provided with tabs, and one of the tabs in the deck of jackets is engaged by the selector picker and the selected jacket is then withdrawn from the deck, it may carry with it non-selected jackets which adhere thereto and cannot in many cases be dislodged by a vibratory action.

SUMMARY OF THE INVENTION

In view of the foregoing, the main object of this invention is to provide an improved random-access card file system in which an automatic selector is adapted to remove any desired card stored in a cartridge regardless of its location therein, and to extract the selected card without at the same time withdrawing from the cartridge non-selected cards which stick onto the selected card. More particularly, an object of this invention is to provide in a card selector a pair of retractable card separators which in their operative position straddle the corners of the card deck from which a selection is being made, the separators acting to permit withdrawal from the deck of only the card selected for removal.

Also an object of this invention is to provide a low-cost random-access system of the above type whose operation is efficient and reliable.

Briefly stated, these objects are attained in a random-access card file system formed by card-storing cartridges, each capable of accommodating at least one deck of cards, and an automatic card selector adapted to extract any desired card therefrom regardless of its location in the cartridge. Each card in the deck includes an upstanding tab whose longitudinal position is related to a particular point on an incremental linear scale extending the full length of the deck.

The selector includes a carriage movable to a position in registration with any desired incremental point on the scale, the carriage supporting a crane having a card picker thereon, whereby when the carriage is set to a particular scale point and a switch is actuated, the crane completes an operating cycle in the course of which it bows down over the cartridge to enable the picker to engage and clamp onto the tab of the selected card and to then lift the card to withdraw it from the cartridge.

To prevent the picker from also withdrawing cards that stick on to the selected card, the upper corners of the deck are straddled by a pair of card separators, each having a row of gaps therein capable of passing only a single card, the entry to each gap in the row being defined by converging walls. When a selected card is lifted above the deck by the picker and other cards sticking to the selected card are also lifted, as the picker rises, it draws the upper corners of the selected card through the nearest entry in the row for passage through its gap, the other cards being intercepted by the walls of the entry and being caused to fall back into the deck.

Where the card used in the system is not of uniform thickness, but has an increased thickness as one moves from the upper to the lower edge thereof, the selector for such cards includes means to normally maintain the card separators in a retracted position with respect to the upper corners of the card deck and to bring the separators into their operative position at the moment when the picker is beginning to lift a selected card, the separators being held in this position long enough to effect card separation, after which the separators are retracted.

OUTLINE OF THE DRAWING

For a better understanding of the invention as well as other objects and further features thereof, reference is made to the following detailed description to be read in conjunction with the accompanying drawing, wherein:

FIG. 2 is a front elevational view of the card separators on the selector mechanism in relation to the cartridge from which cards are being selected;

FIG. 12 is a front view of the card separator;

FIG. 13 is a side view of a single blade of the type included in the separator;

FIG. 14 is a front view of the blade;

Figures 3, 5, 16:
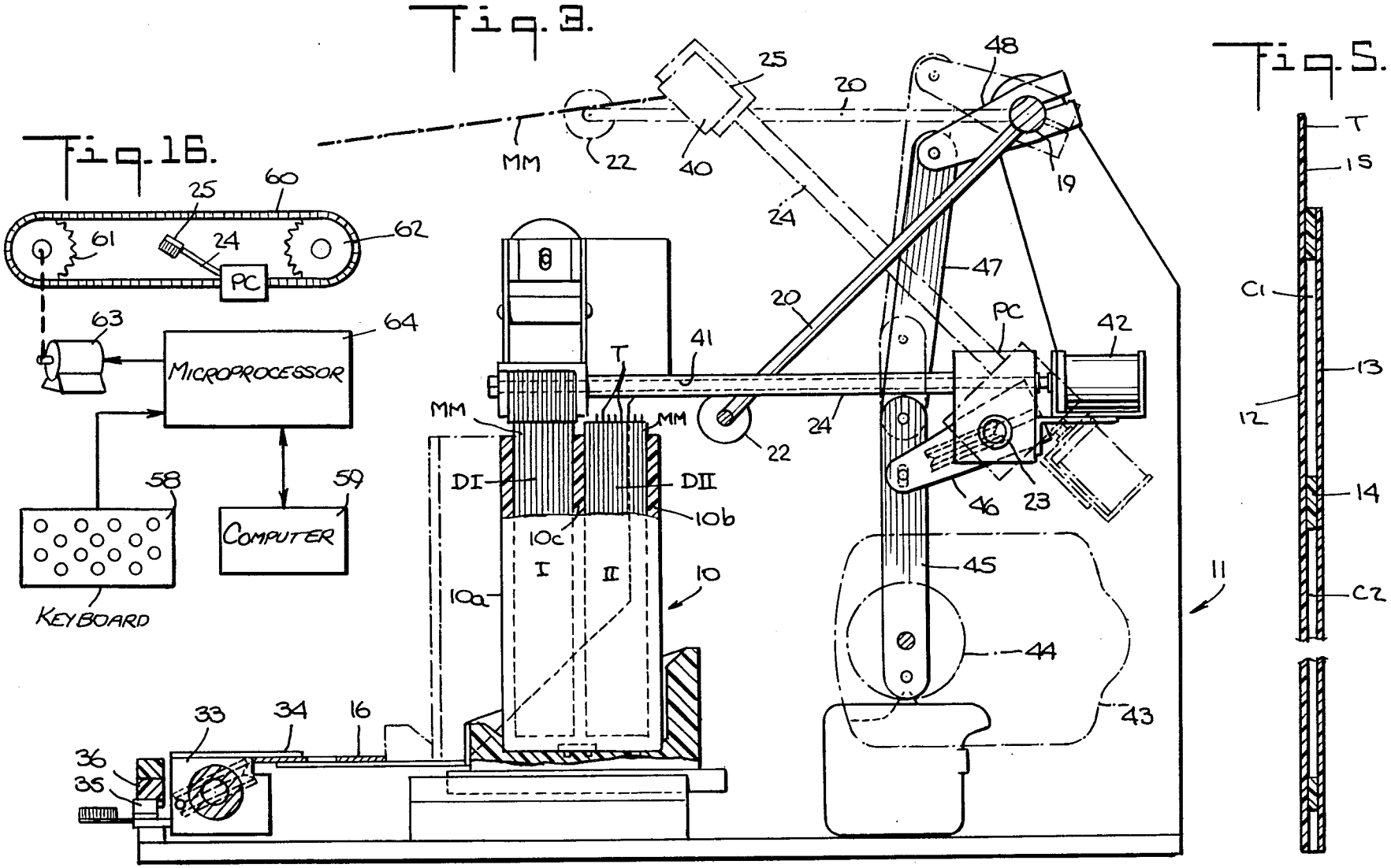
FIG. 3 is a side view of a selector mechanism in the lowered position of the picker crane, the raised position thereof being shown in dashed lines.
FIG. 5 is a transverse section taken through the file card in the plane indicated by line 5—5 in FIG. 4.

FIG. 15 diagrammatically illustrates the operation of the card separator; and FIG. 16 illustrates schematically a selector in accordance with the invention which is controlled either by a keyboard or by a computer to effect card selection.

DESCRIPTION OF THE INVENTION

The Basic Random-Access System

Figure 1:
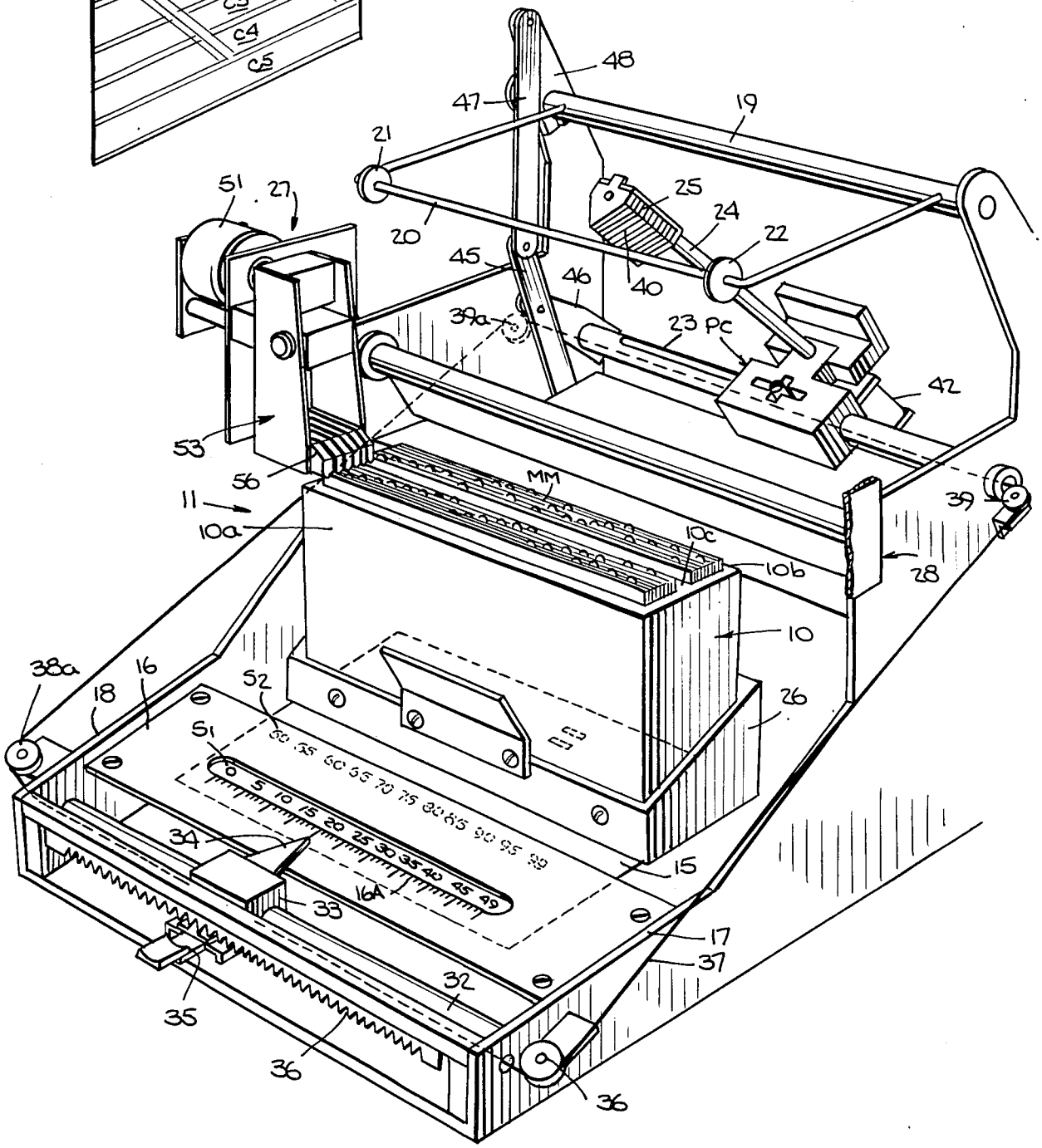
FIG. 1 is a perspective view of a random-access filing system in which file cards are stored in a cartridge and are extracted therefrom by an automatic selector mechanism which includes card separators in accordance with the invention.

Referring now to the drawing, and more particularly to FIGS. 1 and 2, there is shown a cartridge and an automatic selector combination in accordance with the invention, the former being generally designated by numeral 10, and the latter by numeral 11. In practice, the filing system may be constituted by a large assembly of cartridges and a single selector to extract cards from any cartridge in the assembly.

To give a simple example, if the system is intended for the storage of, say, a maximum of 10,000 file cards, one may provide one hundred cartridges, each capable of accommodating one hundred cards. Obviously there may be fewer than 100 cards in any cartridge. These cartridges may be placed in a compartmentalized cabinet for ready access, or the cartridges may be arranged on a rotary turret or turntable, or in a Ferris-wheel type of storage device adapted to be indexed to present a selected cartridge to the user. As pointed out previously, existing filing facilities for a non-random system may be used to house the cartridges for the random-access system.

For purposes of illustrating the invention, we shall stay with the example given above and now consider a cartridge 10 designed to accommodate one hundred cards of the microfiche jacket type disclosed in the above-identified Engelstein and Dorman patents, modified to function in the random-access system. Again, it is noted that the invention is usable with any form of card, but regardless of the type of card employed, it must be provided with tabs as hereinafter described.

Cartridge 10, as seen in FIGS. 1 and 3, is an open-top box-like structure, preferably made of high-strength plastic material, including front and rear walls 10*a* and 10*b*, and an intermediate wall 10*c* partitioning the interior into front and rear compartments I and II of equal size. Each compartment is capable of storing a deck of fifty cards. The dimensions of the compartments relative to the cards received therein are such that the upper margins of the cards are exposed.

Figure 4:
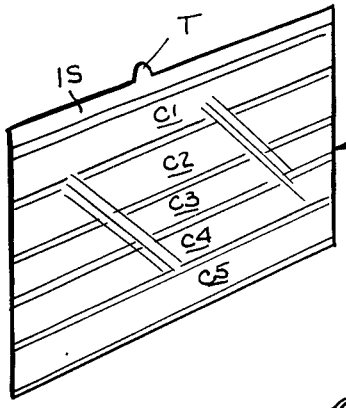
FIG. 4 is a perspective view of one of the file cards.

The microfiche jacket cards MM, as best seen in FIGS. 4 and 5, are each constituted by transparent rectangular front and rear panels 12 and 13 in superposed relation, the panels being formed of clear, flexible plastic material, such as polyester or "Mylar" film having high tensile strength. Interposed between these panels and bonded thereto are spacer ribs formed by longitudinally-extending strips 14 in parallel relation to define parallel channels $C_1$ to $C_5$ open at either end. The channels are of like width to accommodate microfilm strips of a given size, such as 16 mm. or 35 mm. film.

As shown in FIG. 3, a deck $D_I$ of fifty cards MM is stored in compartment I of cartridge 10, and a like deck $D_{II}$ is stored in compartment II. The cards in each deck are provided with upstanding tabs T. When the cards are microfiche jackets, these tabs may be fabricated by extending the rear panel 13 of the microfiche jacket above the uppermost rib 14 to form an identifying strip 1S thereabove having an extension which is die-cut to define the rounded or tapered tab profile. Since with a microfiche jacket of the Engelstein or Dorman type, the rear panel is formed of a relatively heavy plastic sheet whereas the front panel is much thinner to facilitate contact printing, the resultant tab is stiff and durable. Alternatively, the tabs need not be integral with the card but may be separately formed and bonded to the cards at appropriate positions.

With two decks of fifty cards each contained in every compartmentalized cartridge, for indexing purposes the one hundred cartridges for a file system of 10,000 cards may be identified in a master index by cartridge numbers 1 to 100, and the cards in deck I by card numbers 0 to 49, and those in deck II by card numbers 50 to 100.

In order to facilitate selection, tabs T of the cards in each of decks $D_I$ and $D_{II}$ are placed to occupy distinct longitudinal positions relative to scales $S_I$ and $S_{II}$ printed in parallel relation on a scale plate 15 which is shiftable relative to a masking strip 16 whose ends are secured to the frame. Strip 16 is provided with an elongated window along whose lower edge is printed a row of indicia 16A. In one position of the plate, the scale $S_I$ is aligned with the indicia 16A and scale $S_{II}$ is hidden, and in the second position thereof, scale $S_I$ lies under and is hidden by the strip, whereas scale $S_{II}$ is in alignment therewith.

Scale $S_I$ is graduated from 0 to 49; hence the tabs T formed on the front deck $D_1$ of cards are displaced from each other to occupy positions in longitudinal alignment with the incremental points on this scale. Scale II is graduated from 50 to 99, the increments of which correspond to the increments 0 to 49 on Scale $S_I$. Tabs T formed on the rear deck $D_{II}$ of cards are also displaced from each other to occupy positions in longitudinal alignment with the incremental points on the related scale.

Since the scale increments are the same for both decks, the series of tab positions thereon is the same, the distinction residing in whether the deck is placed in the front or rear compartment of the cartridge. It will be appreciated that the number of tabs one may place on a deck of cards depends on the length of the deck and the size of the tabs, as well as the ability of the selector to discriminate between displaced tabs.

While in the system described above, a distinct tab position is assigned to each card, one may have two or more cards in a deck with the same tab position, as in those situations where data related to a particular subject cannot be contained on a single card.

In the master index for a system as described above, the cards are identified by their cartridge, compartment, and tab position. Thus a card identified in the master index as 93-II-77 is to be found in cartridge 93, rear compartment II thereof, and tab position 77. However, while this card belongs in the rear compartment of cartridge 93, it may be placed at any random position in this compartment, for the selector is adapted to pick up this card regardless of its placement in the deck.

Figure 10:
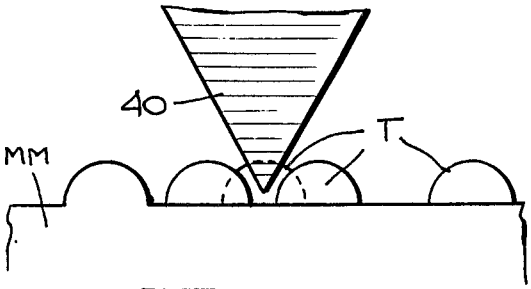
FIG. 10 shows the relationship between the teeth of the picker comb and the tab of the selected card.

In practice, as shown in FIG. 10, it is possible to place the tabs, which have a rounded formation, fairly close to one another so that they overlap, as long as the displacement is sufficient for the selector comb (to be later described) to pick a desired tab without engaging an undesired tab. The tabs need not be rounded but may have any other formation facilitating their selection, such as a trapezoidal form.

As best seen in FIG. 1, selector 11 is provided with a frame having stepped side walls 17 and 18. Mounted on top of the frame at its rear and extending between the side walls is a rotatable shaft 19 which supports a "U" shaped presentation bar 20, having a pair of discs 21 and 22 at the bends thereof. These discs form end guides for the card presented by the bar.

Positioned below shaft 19 and also extending between side walls 17 and 18 is a slotted shaft 23, serving as a track for a picker carriage PC which is keyed to the slot in the shaft and is movable with limits determined by the slot length. Anchored in the carriage and extending therefrom is the arm 24 of a crane, at the end of which is attached a card picker 25.

Cartridge 10 containing two decks of cards $D_I$ and $D_{II}$ is received in a tray 26 joined to scale plate 15, the tray and scale plate being slidable along underlying tracks from a first station to a second station. At the first station, deck $D_I$ lies in operative relation to the picker thereover, in which event scale $S_I$ is aligned with indicia strip 16. At the second station, card deck $D_{II}$ and scale $S_{II}$ are in their operative positions.

Mounted on side walls 17 and 18 on either side of cartridge 10 in positions straddling the upper corners of the card deck which is in operative relation to the picker thereon are card separators 27 and 28 whose structure and function will be later described.

Shiftable along a cross bar 32 extending between the side walls of the frame at the front thereof is an indicator 33 having a pointer 34 which scans indicia strip 16. Indicator 33 is provided with a finger piece to which, as best seen in FIGS. 2 and 3, a spring-biased detent blade 35 is coupled. Detent blade 35 engages the teeth of a rack bar 36. Thus, to shift indicator 33, one presses down on the finger piece to disengage the detent blade 35 from the rack teeth. When the indicator is aligned with a selected scale position, the finger piece is released to cause the detent blade to engage the rack teeth, thereby locking the indicator setting.

Indicator 33 is operatively linked by a cable 37 running over pulleys 38 and 39 supported on side wall 17 and pulleys 38*a* and 39*a* on side wall 18, to picker carriage PC, the cable passing through hollow shaft 23 serving as the carriage track. Thus, movement of indicator 33 in one direction brings about an equal shift in the position of picker carriage PC in the opposite direction. The cards in cartridge 10 have their backs to scales $S_I$ and $S_{II}$; hence picker 25 which sees the front of the cards, has a proper scale relation thereto.

The Picker Mechanism

Figure 6:
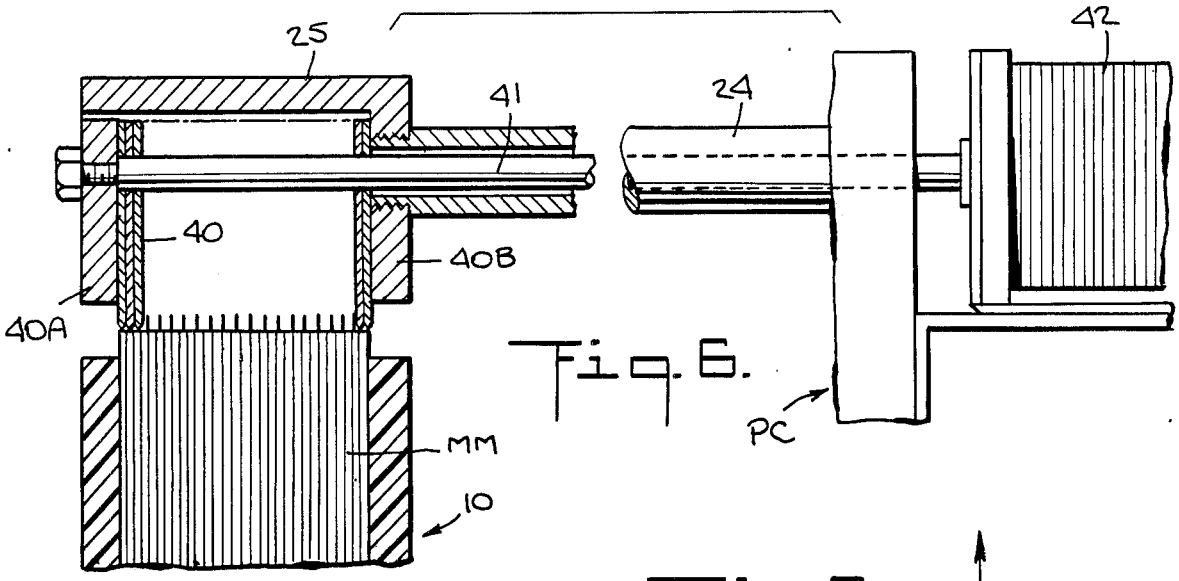
FIG. 6 is a longitudinal section taken through the picker crane and the related deck of cards in the cartridge.

We shall now, in connection with FIGS. 3 and 6, consider the nature of the crane and picker assembly. Picker 25 is provided with a stack of identical teeth 40 of triangular shape, preferably formed by metal plates. The teeth are loosely supported on a rod 41 passing coaxially through the hollow arm of crane 24 and terminating in an electromagnet 42 mounted on picker carriage PC.

The stack of teeth 40 forms a comb which is interposed between a pressure plate 40A and a back plate 40B, the pressure plate being secured to the free end of rod 41 and the back plate being secured to the free end of crane arm 24. The arrangement is such that when electromagnet 42 is energized, rod 24 is pulled thereby, causing pressure plate 40A to move toward back plate 40B and thereby compress the teeth 40 therebetween.

Figure 7:
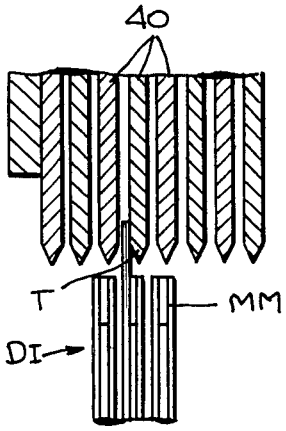
FIG. 7 illustrates the loose teeth of the picker comb at the point at which a card tab is first engaged.
Figure 8:
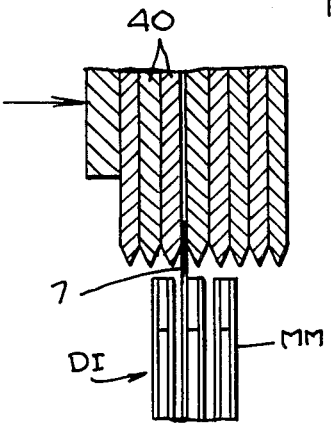
FIG. 8 illustrates the teeth of the comb in the pressed state serving to clamp the engaged tab.
Figure 9:
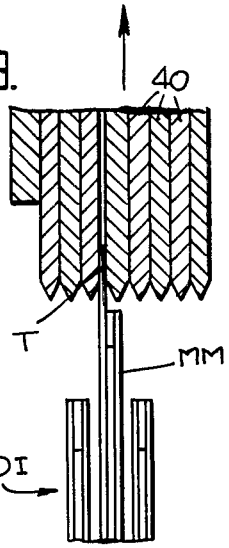
FIG. 9 shows the picker extracting the selected card from the deck.

Thus, as shown in FIG. 7, when picker 25 is brought down, teeth 40 approach the top of card deck $D_I$ (or $D_{II}$) composed of cards MM. The tab T on the card, which is in exact line with the picker, is received between a pair of adjacent loose teeth 40. And when the solenoid of electromagnet 42 is energized, the teeth in the comb are compressed in the manner shown in FIG. 8, whereby tab T of the selected card is now firmly clamped between the pair of teeth. When, thereafter, as shown in FIG. 9, picker 25 is raised by the crane, the selected card MM, whose tab T is gripped by picker 25, is extracted from the card deck.

Figure 11:
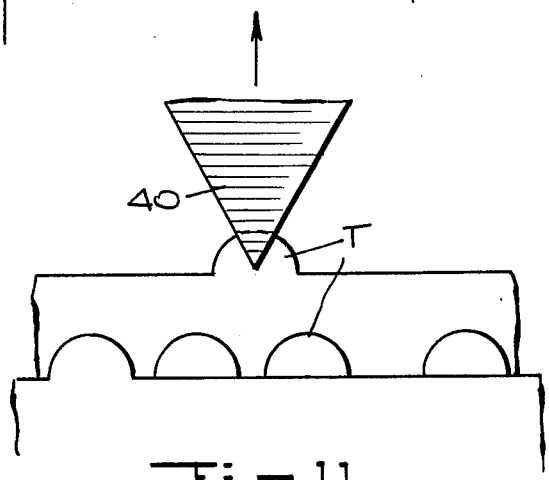
FIG. 11 shows the selected card being lifted by the picker comb.

Thus, as evident in FIG. 10, the triangular teeth 40 engage and grip only that tab in direct line therewith, all other tabs being disregarded including those of other cards which lie in overlapping relation to the gripped tab. When the picker is thereafter raised as shown in FIG. 11, only the selected card MM is withdrawn from the deck.

The mechanism by which the crane and the presentation bar are caused to swing or bow in the course of each operating cycle will now be explained in connection with FIG. 3. Power for operating the selector is provided by a motor 43 whose armature shaft is keyed to an eccentric 44, which is linked to a first bell crank formed by levers 45 and 46, the latter being coupled to carriage shaft 23, and to a second bell crank formed by levers 47 and 48, the latter being coupled to presentation bar shaft 19.

At the beginning of the operating cycle, presentation bar 20 as indicated by dashed lines in FIG. 3, is at a raised horizontal position above cartridge 10 and crane arm 24 bearing picker 25 is upwardly extended. In the course of a single revolution of the motor eccentric, picker 25 is lowered to engage a selected card in the cartridge and to extract the card from the deck as the picker returns to its initial position.

Concurrently with the picker action, presentation bar 20 is first lowered to a position inwardly displaced relative to the lowered picker and then, as the picker rises to extract the selected card, the presentation bar is raised to its initial position in front of the picker, at which point it lies below the extracted card and causes it to assume a horizontal position as shown in dashed lines in FIG. 3. Thus, at the end of the cycle, the extracted card is outstretched to facilitate its removal by the operator from the picker.

The circuit by which the various operations may be carried out in their proper sequence in the course of a cycle is illustrated and described in detail in the Englestein-Dorman patents referred to above.

We shall now briefly review the technique by which a card is selected and the manner in which the selector functions. Let us assume there is call for a card whose master index number is 93-II-77. This means that this card is to be found somewhere in rear compartment II of cartridge 93, and that its tab position is 77 on the scale $S_{II}$ for the rear compartment.

All the operator need do is to take cartridge 93 from the file cabinet or wherever else it is stored. Before placing the cartridge in the tray of the selector, the operator shifts the tray to a station which renders scale II operative and he tnen sets indicator 33 to position 77 in scale II. Then the operator places the cartridge in the tray, thereby actuating the microswitch which initiates the selection cycle.

This causes the picker to bow down over the cartridge to select the desired card from compartment II and to clamp onto the tab thereof, the picker then rising to extract the selected card.

As the picker returns to its initial position, the presentation bar which was lowered as the picker bowed, rises to a position in front of the picker to force the card held thereby to a horizontal position to facilitate its removal from the picker, at which point the cycle is concluded and the system is in readiness for the next cycle. This entire operating cycle is completed in a matter of seconds.

Card Separator

Each card separator 27 and 28, as best seen in FIGS. 2 and 12, includes a mounting plate 50 attached to a side wall (17 and 18) of the selector mechanism. Supported on the rear of mounting plate 50 is an electromagnetic solenoid 51 having a ferromagnetic plunger 52 coaxially disposed therein. The plunger is operatively coupled to the upper end of a rocker frame 53 formed by a pair of parallel plates 53A and 53B. Interposed between rocker frame 53 and solenoid 51 is a helical biasing spring 54 which surrounds plunger 52.

Rocker frame 53 is swingable about a horizontal pivot bolt 55 which bridges frame plates 53A and 53B at an intermediate position thereon. Clamped between plates 53A and 53B at the lower end thereof is a stack of flat blades 56 having a pair of bores therein through which clamping bolts 57 extend to form a laminated separator block. Alternatively, this block need not be of laminar construction and may be machined of a single block of metal or precision molded of plastic material.

Each blade 56 in the stack, as shown separately in FIGS. 13 and 14, is formed of flat ground stock to define a projecting nose 56A whose opposite faces 56B and 56C are slightly relieved to reduce the thickness of the nose and whose base 56D is triangulated. When, therefore, the blades are clamped together, as shown in FIG. 12 and 15, they define a uniform row of equispaced gaps G, each having an entry formed by the converging side walls $W_1$ and $W_2$ of the adjacent blades. Because the blades are precision ground, gaps G have an exact width.

When solenoid 51 is actuated, plunger 51 then pulls rocker frame 53 toward plate 50 to compress spring 54, the frame swinging on pivot 55 to bring the noses of blades 56 directly over the upper corners of the card deck in cartridge 10, as shown in FIG. 2. As a consequence, no card can be removed from the deck without first passing through the separators which straddle the deck. When solenoid 51 is de-energized, the released spring 54 then acts to swing rocker frame 53 so that the noses of the blades 56 are retracted with respect to the upper corners of the card deck. This action requires only a slight displacement to clear the corners.

In practice, the timing of the solenoid energization is synchronized with the operation of the picker, so that when the picker has clamped onto the tab T of a particular card, and it then proceeds to lift this card, at that moment the solenoid of the separator is energized to cause the separator to assume its operative position. This position is maintained for a brief interval sufficient to permit the upper margin of the card to pass through the separator, after which the separator is retracted.

The manner in which separation is effected is illustrated in FIG. 15 which schematically illustrates a row of gaps G formed by the clamped stack of blades 56, each gap having a converging entry thereto defined by the walls $W_1$ and $W_2$ on the bases of adjacent blades. These walls are smooth and polished so that when a card $MM_s$ selected by the picker is lifted from the card deck below the row of gaps, the card then enters the entry nearest thereto and is deflected by the entry wall in line therewith toward gap G whose width is slightly greater (i.e., by a fraction of a mil) than the thickness of the upper margin of the card. This fraction is preferably about 10% of the card thickness.

Hence the card being lifted by the picker is deflected by the entry wall toward gap G; and because the gap has a width just wide enough to accommodate the upper margin of the card, the margin is admitted into the gap. However, non-selected card $MM_1$ which sticks onto selected card $MM_s$ and non-selected card $MM_2$ which sticks onto card $MM_1$ are both intercepted by the entry wall; since they cannot pass through the gap, they are dislodged and fall back into the deck.

The slope of the converging entry walls $W_1$ and $W_2$ must be sufficient to effect deflection of the cards striking the walls, but not so great as to cause a non-selected card adjacent the selected card to catch in the gap.

The reason why it is necessary to retract the card separator is that when the cards in the system are in the form of microfiche jackets of the type shown in FIGS. 4 and 5, the cards are not then of uniform thickness. In the microfiche jacket, as previously explained, the upper index margin 15 is of single ply material; but as one moves toward the lower edge, the uppermost rib 14 is encountered, at which point the jacket is of thicker double ply construction.

Since the separator has a row of gaps therein of a width substantially equal to the thickness of the upper margin of the card, when the card is of uniform thickness, as with a card made from a single sheet of material, the separators may be kept in place and there is no need for their retraction. However, in the case of cards in the form of microfiche jackets, retractions must be carried out to prevent the jacket from jamming in the gaps.

Keyboard or Computer Control

In the selector shown in the figures of the drawings, indicator 33 is manually adjusted by an operator to set the picker carriage to a scale position for withdrawal of a particular card in the deck. Alternatively, this operation may be carried out from a keyboard 58 as shown in FIG. 16, or from a remote computer 59.

In the arrangement shown in FIG. 16, the picker carriage PC is linked to a continuous sprocket chain 60 extending between and supported by two sprocket wheels 61 and 62. Sprocket wheel 61 is driven in either direction by a bi-directional pulse motor 63.

If we assume that picker carriage PC is to be incrementally set to any point along a linear scale of 0 to 49 in order to pick out any card in a deck of 50, then the arrangement must be such that it takes a predetermined number of pulses applied to stepper motor 63 to shift the carriage one increment along the scale. Each pulse applied to the motor causes it to take a single minute angular step and to turn the sprocket wheel 61 accordingly. Hence, depending on the motor used and the parameter of scale increment, it may take, say, five stepping pulses per scale increment in which case to move, say, three increments along the scale; 15 pulses must be applied to the motor.

Motor 63 is under the control of a microprocessor 64 which receives digital data from keyboard 58 and translates this data into the required number of stepping pulses to cause the sprocket chain 60 to position picker carriage PC to the desired scale position. If, for example, the operator keys in the number 29 to obtain a card whose tab is 29 on the scale, then the microprocessor must, in response to the number 29 keyed therein, supply the appropriate number of positive pulses to the stepping motor to cause it to go from the 0 scale position to position 29. But if the next number keyed in is 21, the microprocessor, which stores the previous entry in the memory, then supplies the number of negative pulses required to cause the picker carriage to shift back from 29 to 21.

The data for positioning the picker carriage need not be entered into a keyboard but may be supplied to microprocessor 64 from a remote computer 59. And when the selector under instructions from a remote computer selects a particular card, this card may be presented automatically to a video camera to transmit the image thereof to a television terminal at the remote computer.

Thus, in the present invention, the operation of the selector is partially or fully automatic. Among the significant features of the present invention are the following:

A. The selection action is rapid, for once the carriage is set to a desired incremental point on the scale and a switch actuated, a cycle is initiated in which the picker moves toward the card deck in the cartridge and acts to engage the tab of the selected card, after which it rises to extract the card.

B. The picker action is positive, and when it engages the tab of the selected card, it clamps itself firmly thereon. Because the teeth of the picker are initially in loose condition, these teeth accommodate themselves to card tabs of different thickness or tabs which may become deformed in use.

C. The picker, after clamping onto the tab, draws the selected card through a card separator which dislodges other cards which may adhere onto the selected card, so that only the selected card is extracted.

D. The picker raises the selected card onto a presentation bar which holds the selected card horizontally for easy removal.

E. The automatic picker action is initiated the moment the cartridge containing the cards is put in place for selection.

F. The automatic selector is adapted to cooperate with a cartridge having a pair of compartments for receiving two decks, the cartridge being received on a slidable tray which may be quickly shifted from a first station in which one of the decks is oriented for selection to a second station in which the other deck of so positioned.

While there has been shown and described a preferred embodiment of IMPROVED AUTOMATIC CARD SELECTOR FOR RANDOM-ACCESS CARD FILE SYSTEM in accordance with the invention, it will be appreciated that many changes and modifications may be made therein without, however, departing from the essential spirit thereof.

I claim:

1. A random-access card file system provided with cartridges each storing at least one deck of cards, each card including an upstanding tab whose longitudinal position corresponds to a particular point on an incremental scale running the full length of the deck, and a card selector for extracting any desired card from the deck regardless of its stored location in the cartridge, said selector comprising:

(A) a carriage movable along a horizontal path above the cartridge which houses a deck that includes a card to be selected, to a point in the path in line with the tab on said card;

(B) a crane supported on the carriage and having a card picker thereon;

(C) operating means which when actuated cause the crane to complete an operating cycle in the course of which it bows down over the cartridge to enable the picker to engage and clamp onto the tab on said card and to then lift the card by its tab to withdrawn it from the cartridge; and (D) separator means disposed just above the cartridge to assume an operative position relative to said deck as said picker lifts the selected card by its tab to intercept non-selected cards sticking on to the selected card to prevent the picker in the course of lifting the selected card from also withdrawing non-selected cards; said separator means being constituted by a pair of card separators just above the cartridge to straddle the upper corners of the card deck, each separator having a row of gaps therein whose width is slightly greater than the thickness of the upper margin of the card so that the gap is capable of passing only a single card therethrough, each gap having an entry defined by converging walls, the entry having a longitudinal axis which is parallel to the plane of the card, whereby when the selected card is lifted above the deck by the picker and adjacent cards sticking to the selected card are also lifted, as the picker rises, it draws the upper corners of the selected card through the entry nearest thereto for passage through the gap associated therewith, the other cards being intercepted by at least one wall of the entry to be dislodged from the selected card; said separators including a clamped stack of flat blades each having a nose provided with opposing faces and a base, said faces being formed with a step portion to reduce the thickness of the nose to define said gaps, said base being triangulated to define the converging entry walls.

2. A system as set forth in claim 1, wherein the width of the gap is about 10% greater than the thickness of the upper margin of the card.

3. A system as set forth in claim 1, wherein said stack is clamped between a pair of plates defining a frame of the separator.

4. A system as set forth in claim 1, wherein said selector includes a pair of side walls between which said cartridge is placed, and said separators are supported above the cartridge on said walls.

5. A system as set forth in claim 4, wherein the frame of each separator is pivotally supported on one wall of said selector so that it is rockable thereon and is spring-biased to normally retract the separator relative to the upper corner of the deck, and a solenoid operatively coupled to the frame whereby when the solenoid is energized, it rocks the frame into its operative position relative to the card deck.

6. A system as set forth in claim 1, wherein said carriage is linked to a sprocket chain supported between sprocket wheels to travel along said path, and further including a bidirectional stepping motor coupled to one of said wheels to shift the carriage to said point.

7. A system as set forth in claim 6, wherein said stepping motor is provided with actuating pulses by a microprocessor having numerical data entered therein indicative of the selected point.

8. A system as set forth in claim 7, wherein said numerical data is supplied by an operator keyboard.

9. A system as set forth in claim 7, wherein said numerical data is supplied by a remote computer.

* * * * *